United States Patent [19]

Nagasaka

[11] Patent Number: 4,772,982

[45] Date of Patent: Sep. 20, 1988

[54] POWDER CHARGING APPARATUS AND ELECTROSTATIC POWDER COATING APPARATUS

[76] Inventor: Hideo Nagasaka, 2-21-33, Minamikohya-cho, Hitachi-city, Ibaraki-prefec., Japan

[21] Appl. No.: 930,732

[22] Filed: Nov. 13, 1986

[51] Int. Cl.[4] ..... B05B 5/02

[52] U.S. Cl. ..... 361/227; 239/690; 239/707

[58] Field of Search ..... 361/226–227; 239/690–708

[56] References Cited

U.S. PATENT DOCUMENTS

| | | | |
|---|---|---|---|
| 3,940,061 | 2/1976 | Gimple et al. | 239/707 X |
| 4,135,667 | 1/1979 | Benedek et al. | 239/697 |
| 4,289,278 | 9/1981 | Itoh | 361/227 X |
| 4,515,105 | 5/1985 | Danta et al. | 239/707 X |

*Primary Examiner*—Michael L. Gellner

*Assistant Examiner*—D. Rutledge

*Attorney, Agent, or Firm*—Price, Heneveld, Cooper, DeWitt & Litton

[57] ABSTRACT

It is described a novel powder charging apparatus, wherein a high voltage is applied between a couple of electrodes, consisting of a plasma electrode of required polarity and a plasma electrode of opposite polarity, to form plasma at tip of each of electrodes, an eventually finely dispersed powder is made to pass only through an area wherein mainly ones of negative and positive ions derived of said plasma, that is, ions of required polarity exist, and thereafter the charged powder is discharged. In this apparatus, the adhesion of powder to each electrode is prevented and charging performance is maintained for a long time. It is also described an electrostatic powder coating apparatus comprising the above-described novel powder charging apparatus, which is excellent in performance for making thick coating, depositing efficiency and throwing power.

30 Claims, 12 Drawing Sheets

POWDER CHARGING APPARATUS AND ELECTROSTATIC POWDER COATING APPARATUS

FIELD OF THE INVENTION

This invention relates to a powder charging apparatus for charging a powdered coating material to be used in electrostatic powder coating, and to an electrostatic powder coating apparatus for coating a substrate with a powdered coating material which has been charged by the powder charging apparatus just described.

DESCRIPTION OF THE PRIOR ART

In the prior art, there are various powder charging apparatuses for the electrostatic powder coating and various electrostatic powder coating apparatuses provided with such powder charging apparatuses. First, it is a powder charging apparatus wherein a ring-formed electrode is arranged along the inside peripheral surface of a conduit for conveying a powder by gas, a corona discharge electrode is so arranged that its tip is placed along the axis of the conduit, an ionic current is made to flow from the corona discharge electrode to the inside circular surface of ring-formed electrode, and the powder flowing in conduit is charged when the powder passes across the ionic current.

Secondly, it is a powder charging apparatus wherein a ring-formed slit having an opening directed downstream is arranged to skirt the upstream circular edge of the inner surface of above-mentioned ring-formed electrode, and a clean gas at high speed blown out of said slit sweeps over the inner peripheral surface of ring-formed electrode to keep always the surface clean.

Thirdly, it is a powder charging apparatus wherein the ring-formed electrode as those in the first and second apparatuses is shaped to have a cylindrical inside surface having a section of concaved and broadening downstream contour, and a ring-formed slit having an opening directed upstream is arranged at the downstream edge of concaved inside surface of ring-formed cylindrical electrode.

In the first and second apparatuses mentioned above, the powder flowing in the conduit is charged at the place where the powder traverses a radiate ionic current. In general, a powder flowing in a conduit is subject to influences of gravity, bendings of upstream pipe line, and tend to flow on one side of inside surface of conduit. Moreover, as the above-mentioned radiate ionic current approaches the inside peripheral surface of conduit from its axis, the charge density of ionic current decreases. Thus, the powder of coating material is liable to traverse part of low charge density. Accordingly, a high charging efficiency cannot be expected.

On the other hand, since a clean air is blown out downstream at high speed from the ring-formed slit, the flow speed of powder increases and the residence time of powder in the conduit decreases. Thus the charging efficiency lowers. When these powder charging apparatuses is employed in a gun of an electrostatic coating apparatus, the depositing efficiency on a substrate could be lowered as the speed of jet blown out of the tip of gun is too high.

In the third apparatus of the prior art, the charging efficiency is made to increase by preventing the powder coating material from traversing an area of low charge density and by causing the powder to pass through an area of high charge density. In addition, the speed of the powder flowing in conduit is decreased by a clean air at high speed which is blown out of the ring-formed slit, whereby the charging efficiency is increased. When the third powder charging apparatus is employed in a gun of an electrostatic powder coating apparatus, the speed of powder blown out of the tip of gun does not be increased. Consequently, the depositing efficiency of powder coating material on a substrate will be increased. The clean air blown out of the opening of ring-formed slit flows along the concaved inside surface of cylindrical electrode from a part having a larger diameter to a part having a smaller diameter, as said opening is directed upstream. Thereafter, the clean air impinges on the powder flowing downstream in the part of conduit which associates with said part having a smaller diameter to incorporate with carrier gas. Then, the powder traverses the ionic current which flows radiately from the corona discharge electrode toward the inside surface of cylindrical electrode. In the course of these flows, the flowing direction of clean air is gradually changed from the upstream direction to the direction toward the axis of conduit as the clean air proceeds along the concaved inside surface from a part having a larger diameter to a part having a smaller diameter. This flow of clean air causes the powder flowiing downstream in the conduit to approach the axis from the peripheral part of conduit. In the meantime, the clean air impinges and intensely agitates the powder being conveyed to disperse finely. In addition, as the flow speed of powder is decreased by a speed component in the direction opposite to the direction of the speed which the powder carrying gas has, the residence time of the powder in the area where corona discharge is being generated is extended.

As a result, the powder flowing in conduit tends to converge toward the axis of conduit, and the powder in a converged state traverses the central area of the radiate ionic current. That is to say, the powder passes through the area of the highest ionic current density and the highest electric field intensity to charge.

The common feature among the powder charging apparatuses of the prior art enumerated above consists in that the plasma is generated only at a corona discharge electrode and a unipolar ionic current derived from the plasma flows to a ring-formed or cylindrical electrode in normal operation. Under these conditions, the powder is passed through the space between both electrodes.

The common problem in these apparatuses of the prior art is that the powder adheres to and is accumulated on the surface of ring-formed or cylindrical electrode in the course of operating the apparatus. Due to a backward dissociation caused on such an electrode, an ionic current in a large amount of opposite polarity begins to flow toward the corona discharge electrode, and thereby charges on powder given by the corona discharge current are neutralized. Charging of the powder is labilized and eventually impossible.

It is a primary object of this invention to solve these problems in the prior art.

SUMMARY OF THE INVENTION

In the apparatus in accordance with this invention, an electrode couple of a plasma electrode of required polarity and a plasma electrode of opposite polarity is employed, in place of the electrode couple of a corona discharge electrode and a ring-formed electrode or the couple of a corona discharge electrode and a cylindrical electrode in the aforementioned apparatuses of the prior art. When a high voltage is applied between both electrodes, plasma is generated at the tip of each of electrodes and a positive and a negative ionic current are drawn from plasma. A powder which has been preliminarily dispersed to a large extent is arranged to pass through an area wherein merely the ionic current having the polarity of which charges on the powder are desired (hereinafter, abridged as "required polarity") exists. Thereafter, the powder is discharged. The apparatus of this invention is provided with means for making the charging performance of ionic current of required polarity larger than that of ionic current of opposite polarity. In addition, the apparatus of the present invention can be provided with means for keeping the powder aloof from an area wherein ions of opposite polarity reside and means for preventing the powder from adhering to plasma electrodes, if necessary. Either of both corona discharge electrodes is earthed, depending on the object of application.

Particles of powder existing near both plasma electrodes are charged by the plasma generated at the tip of plasma electrodes, and are repelled due to effects of plasma, uneven electric field, ionic curent derived from electrode, electric wind, DC repulsive force, and centrifugal repulsive force of uneven AC field, always in operation. As both plasma electrodes have these charging and repelling actions, both electrodes do not subjected to adhesion and accumulation of powder particles. Thus, the performance of both electrodes do not change and a stable operation is possible for a long time. The attachment of adhesion-preventing means to a corona discharge electrode is primarily for preventing the adhesion of powder during the transient state when the starting of operation is stopped.

In these apparatuses, there is always an ionic current of opposite polarity together with an ionic current of required polarity.

The provision of means for keep the powder aloof from the area wherein primarily an ionic current of opposite polority exist and/or making the volt-ampere characteristic of corona discharge electrode of opposite polarity as smaller as possible than that of corona discharge electrode of required polarity, are for minimizing the neuralization of charges on powder by ionic current of opposite polarity, whereby the final amount of charges of required polarity on the powder is made sufficiently large for practical use.

As the powder entering the area of ionic current of required polarity is in the state of finely dispersed, charging of powder is very efficiently achieved.

To arrange a powder charging apparatus according to the present invention in a conduit, a plasma electrode of required polarity is disposed downstream in the conduit made of insulating material and a plasma electrode of opposite polarity is disposed upstream. As a result, the powder having charges of required polarity is obtained from the outlet of the conduit.

When the plasma electrode of required polarity is earthed and arranged downstream near the outlet of the conduit made of insulating material, and the plasma electrode of opposite polarity is arranged upstream, a charged powder is obtained without an external electric field. By spraying thus-obtained powder onto a substrate, an electrostatic powder coating can be achieved with good throwing powder.

When the plasma electrode of required polarity is arranged donwstream near the outlet of the conduit made of insulating material, and the plasma electrode of opposite polarity is arranged upstream and connected to the earthed side, the charged powder can be sprayed onto a substrate without external electric current though an external electric field is present. By this procedure, an electrostatic powder coating can be practiced to obtain a thick coating.

The plasma electrode of required polarity is disposed downstream near the outlet of the conduit with being separated from and confronting a substrate. Additionally, a high voltage is applied so that an ionic current may flow outward from the plasma electrode of required polarity. The corona discharge electrode of opposite polarity is arranged upstream and connected to the earthed side. By this arrangement of charging apparatus, the powder which has been charged within the charging apparatus is again charged in the presence of an external electric field and an external ionic current. Consequently the electrostatic powder coating is performed with a good depositing efficiency and an remarkably excellent throwing powder.

BRIEF DESCRIPTION OF THE DRAWINGS

Above-mentioned and other features and objecs of this invention will become more apparent by reference to the following description taken in conjunction with the accompanying drawings, in which.

DESCRIPTION OF PREFERRED EMBODIMENTS

Figure 1:
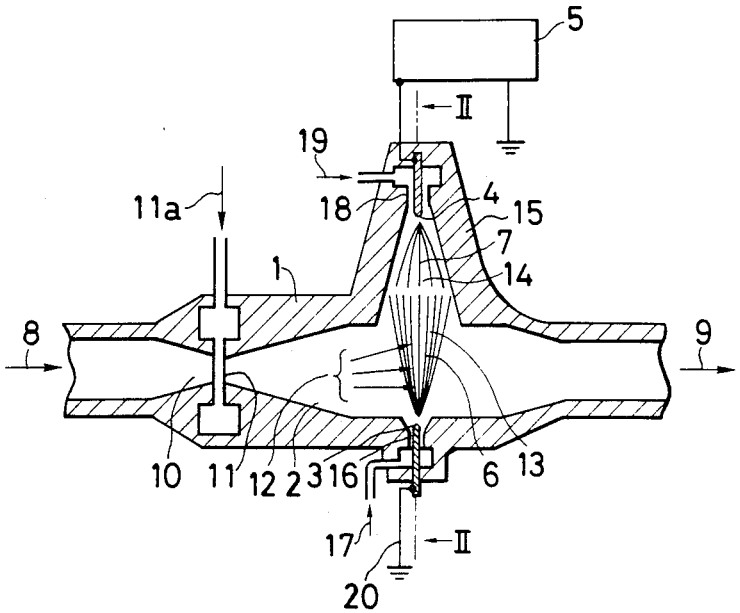
FIG. 1 shows a longitudinal section of a powder charging apparatus as an embodiment of this invention.
Figure 2:
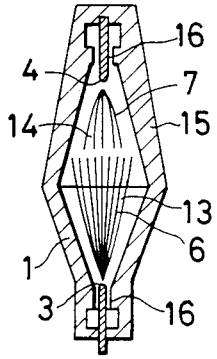
FIG. 2 shows a section taken along the line II—II of FIG. 1, FIGS. 3 to 6 represent longitudinal sections of other embodiments of this invention, respectively.

In a powder charging apparatus of one embodiment of this invention as shown in FIGS. 1 and 2, a plasma electrode 3 of required polarity is formed of a needle having a tip of small curvature radius, and a plasma electrode 4 of opposite polarity is formed of a needle having a tip of large curvature radius. A high voltage from a DC power source 5 is applied between electrode 3 and electrode 4. As a result, a corona discharge of both polarities are generated between two electrodes. A plasma is formed at each of the tips of two electrodes. In this case, as the curvature radius of the electrode 3 of required polarity is smaller, the intensity of an ionic current 6 of required polarity is higher than that of a current 7 of opposite polarity which is derived from the plasma electrode 4 of opposite polarity. In addition, the current 6 exists in a broad and long area. A powder 8 being carried by a gas as shown by arrow is agitated by a restriction 10 and a dispersing gas 11*a* issuing from a jet 11 of dispersing gas provided at the restriction 10 to disperse finely. Thus-obtained finely dispersed powder 12 is electrically charged during passing through a space 13 wherein mainly ions of required polarity exist. Thus, the charged powder 9 is obtained.

In this case, the charge on the powder given by ionic current 6 of required polarity is scarcely neutralized by the ionic current 7 of opposite polarity, because the space 14 where mainly ions of opposite polarity exist is substantially separated from the conduit 2 by means 15 for keeping powder aloof from space 14, as shown by FIGS. 1 and 2. Moreover, these conditions are ensured by an adhesion-preventing gas 19 blown out from a jet 18 of gas provided aroung the plasma electrode 4 of opposite polarity. In the powder charging apparatus according to this invention, the used electrodes are corona discharge electrodes which generate plasma at their tips. Plasmas generated at tips of both corona discharge electrodes and ionic current derived from the electrodes by electric field, together with electric wind and DC repulsing force, give effects that the plasma electrodes charge particles around electrodes during operation and repulse the resulting charged particles from the electrodes. Accordingly, the particles of powder cannot adhere to the electrode to accumulate and the performance of electrodes does not vary. Thus, the apparatus can be operated stably for a long time.

On the other hand, a ring-formed jet 16 of gas is provided also around the plasma electrode 3 of required polarity, through which an adhesion-preventing gas 17 is blown out at high speed. Both adhesion-preventing gases 17 and 19 are principally for inhibiting any adhering of powder to tips of electrodes during the transient state when the starting of torch operation is stopped. When a large capacity of the powder charging apparatus of the type shown in FIG. 1 is required, a plurality of paired electrodes are arranged along the direction of conduit to meet the requirement.

Figure 3:
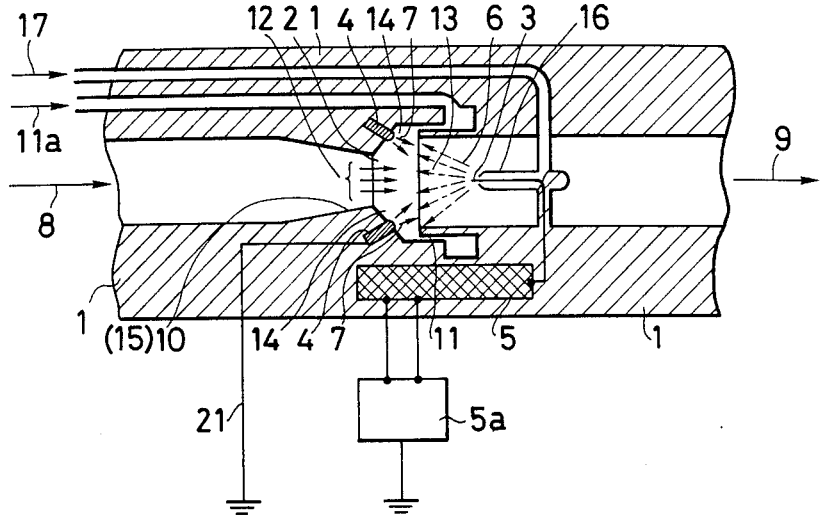

The embodiment shown in FIGS. 3 is composed of a cylindrical body 1, made of insulating material, having circular section in which is formed a conduit 2 for conveying the powder 8 being carried by gas. A thin corona discharge electrode as plasma electrode 3 or required polarity is disposed along the axis of conduit 2, and thick corona discharge electrodes as plasma electrode 4 of opposite polarity are arranged on the peripheral wall of conduit 2 so as to confront the electrode of required polarity. In this case, the inner wall of conduit 2 in the part provided with plasma electrode 4 converges upstream to associate with a restriction 10. A dispersing gas shown by arrow 11*a* is blown out of a ring-formed jet 11 for dispersing gas which is provided downstream, and maintains the tips of plasma electrodes of opposite polarity to be clean. The dispersing gas traverses the conduits 2, and agitates the powder to disperse finely. The resulting finely dispersed powder 12 is blown into a space 13 wherein mainly the ionic current 6 of required polarity derived from the tip of plasma electrodes 3 of required polarity exists, and is electrically charged. In this case, the ionic current 7 of opposite polarity derived from the plasma electrode 4 of opposite polarity is small in itself since the curvature radius of tip of electrode 4 is large. Further, the restriction 10 is so constructed that the powder may be kept aloof from the space 7 wherein mainly ions of opposite polarity reside. Consequently, the neutralization of charges of required polarity on the powder with charges of opposite polarity is suppressed. The total charging efficiency can be eventually increased.

In FIG. 3, reference numeral 5 designates a DC power source for applying a DC voltage between both electrodes. Reference numeral 5*a* designates a high frequency power supply for feeding the power source 5. The adhesion-preventing gas 17 which has blown at high speed out of a jet 16 arranged around the tip of the plasma electrode of required polarity plays an important role in preventing the attachment of powder to the tip of the plasma electrode 3 of required polarity, especially in the transient state when the starting is stopped.

Figure 4:
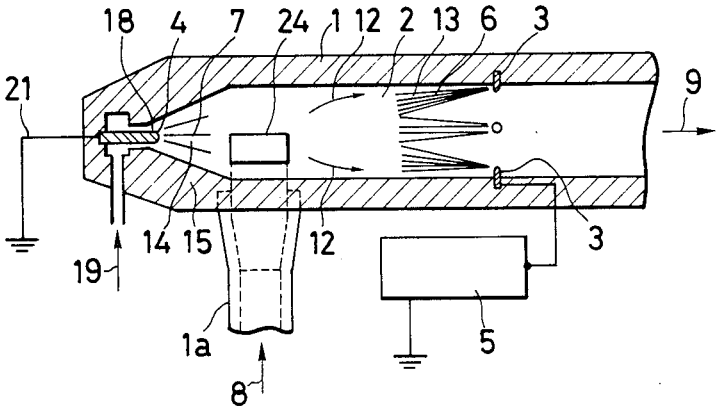

FIG. 4 shows an embodiment wherein plasma electrodes 3 of required polarity are arranged on the inner wall of the conduit 2 formed by a cylindrical body 1. In this embodiment, the powder 8 carried by a gas is introduced tangentially in the conduit 2 upstream from the plasma electrodes 3 of required polarity by way of a powder-introducing conduit 1*a*. An adhesion-preventing gas 19 is admitted into the conduit through a jet 18 of gas formed around the plasma electrode 8 of opposite polarity. When a high DC voltage is applied between the earthed plasma electrode 4 of opposite polarity and the plasma electrode 3 of required polarity by means of a DC power source, a corona discharge is generated between both electrodes and an ionic current 6 of required polarity derived from the electrode 3 of required polarity forms an area 13 containing mainly ions of required polarity along the inner wall of conduit 2. The powder which as been introduced into conduit 2 through a powder inlet 24 revolves at high speed along the wall of conduit to form a finely dispersed powder 12. As the obtained finely dispersed powder 12 passes through the area 13 in which mainly ions of required polarity reside, the highly charged powder 9 can be obtained. In this case, the powder 8 does not substantially pass to the space 14 wherein mainly an ionic current 7 of opposite polarity exist. Such a passing course of charged powder 9 is facilitated by an adhesion-preventing gas 19. Thus, charges on the powder given by ionic current 6 of required polarity are scarcely neutralized with ionic current 7 of opposite polarity. An adhesion-preventing gas can be blown out around the plasma electrode 3 of required polarity, if necessary. In many cases, the strong revolving motion of powder-carrying gas by itself can inhibit any attachment of powder to the plasma electrode 3 of required polarity in the arrangement of the embodiment shown in FIG. 4.

Figure 5:
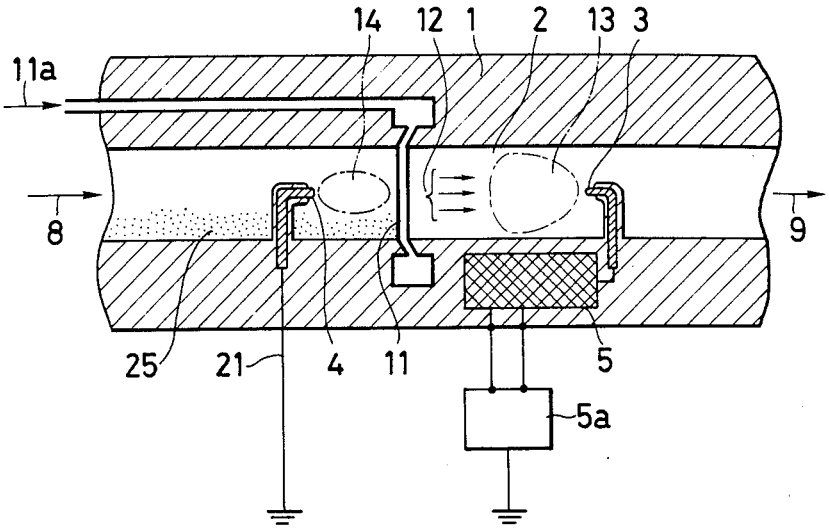

FIG. 5 shows a conduit 2 for conveying a powder 8 carried by gas, which is formed in the interior of a cylindrical body 1 made of insulating material having circular section. The plasma electrode 3 of required polarity which is composed of a needle electrode having a tip of small curvature radius is disposed along the axis of conduit 2, and a plasma electrode 4 of opposite polarity having tip of large curvature radius is arranged along the axis, the latter electrode confronting the former. A DC high voltage is intended to be applied between both electrodes by means of a multistage booster circuit 5 and a high frequency power supply 5*a*. In addition, a ring-formed jet 11 of dispersing gas is arranged somewhat upstream from the midpoint. A dispersing gas 11*a* is blown into conduit 2 through the jet 11.

In a usual powder charging apparatus to be used in an electrostatic powder coating apparatus, conveying of powder in the conduit is rarely required to be performed at high speed in many cases. When this is the case, the powde flows unevenly as shown in FIG. 5. Consequently, when most of powder flow passes under an area 14 wherein mainly ions of opposite polarity reside, the powder is scarcely charged in substance in many cases. The powder having passed through or under the area 14 is immediately subjected to an agitating action of a dispersing gas 11*a* forcibly blown out of a jet 11 to disperse, and then the powder 12 in finely dispersed state passes through an area 13 in which mainly ions of required polarity exist. Thus, neutralization of charges on the powder with charges of opposite polarity can be substantially avoided and the powder is practically subjected only to charging by ions of required polarity, whereby the charged powder 9 stable for a long time is obtained. Whereas, in the other embodiments of this invention (refer to FIGS. 1, 4, 6 and 8), special means only for keeping the powder aloof from the area 14 wherein mainly ions of opposite polarity exist is provided, such special means is not provided in the case of the embodiment shown in FIG. 5. However, it does not mean that the prevention of powder passing through the area 14 is not contemplated in the embodiment of FIG. 5.

Figure 6:
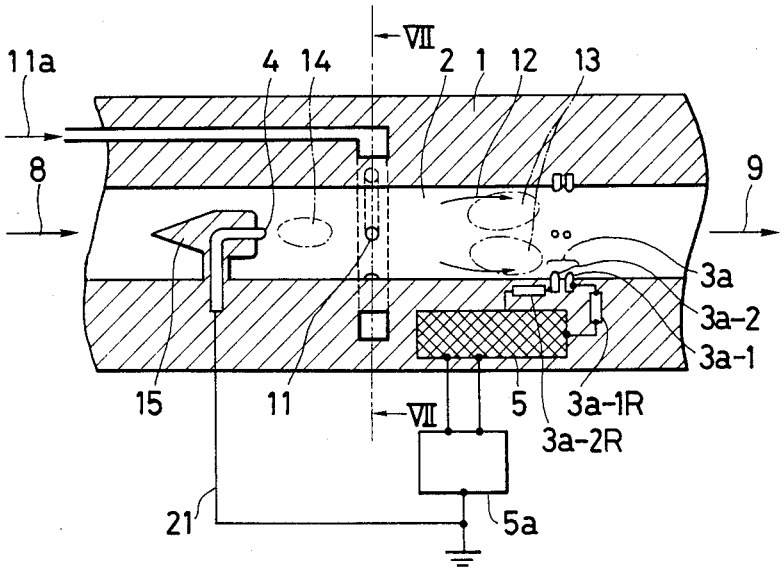
Figure 7:
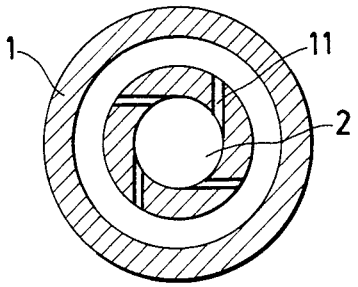
FIG. 7 is a sectional view taken along the line VII—VII of FIG. 6.

In an embodiment shown by FIGS. 6 and 7, a conduit 2 for conveying a powder 8 carried by gas is formed in the interior of a cylindrical body 1 made of insulating material having circular section. A needle electrode having a tip of large curvature radius as plasma electrode 4 of opposite polarity is arranged upstream inside the conduit 2 along its axis. A cone-shaped means 15 for keeping powder aloof from electrode 4 is provided immediately upstream from the electrode 4. A plasma electride 3*a* of required polarity is arranged to confront the electrode 3*a*. In this embodiment, the electrode 3*a* of required polarity is composed of two electrodes 3*a*-1 and 3*a*-2 which are adjacent to each other. Each of electrodes 3*a*-1 and 3*a*-2 is fed with its respective high DC voltage from its respective position of a DC power source via its respective protective resistance 3*a*-1R or 3*a*-2R. The DC power source and two protective resistances are embeded in the cylindrical body. Due to the difference in DC voltage between electrodes 3*a*-1 and 3*a*-2, a plasma is always generated by a minute spark discharge. Whereby, a sufficient amount of ionic current of required polarity is always extracted from the plasma by the plasma electrode 4 of opposite polarity and proceeds toward the electrode 4 to form an area 13 wherein mainly ions of required polarity exist. Reference numeral 5*a* designates a high frequency power supply for feeding the DC power spurce 5. In the middle between the plasma electrode of required polarity and the plasma electrode of opposite polarity, a plurality of jets 11 for blowing out revolving current of gas are formed to open into the conduit 2. A dispersing gas 11*a* is fed through jets 11 to agitate the powder 8 in the conduits 2. The powder 8 finely dispersed by agitation approaches the conduit wall and passes through the space 13 wherein mainly ions of required polarity exist. Thus, a powder 9 having charges of the same polarity is obtained.

In this embodiment, the powder approaches hardly the area 14 wherein mainly ions of opposite polarity exist by virtue of both functions of means 15 for keeping powder aloof from plasma electrode 4 of opposite polarity and of jets 11 for blowing out revolving current of dispersing gas. Accordingly, any neutralization with ions of opposite polarity can be substantially prevented. The charging of a powder can be stably performed with a high efficiency for a long period of time.

Figure 8:
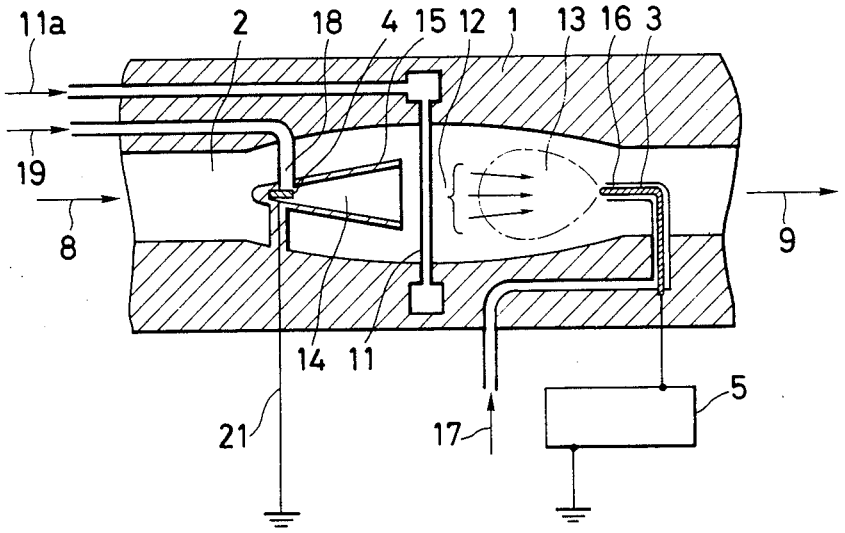
FIGS. 8 to 13 represent longitudinal sections of still other embodiments of this invention, respectively.

In an embodiment shown by FIG. 8, a conduit 2 for conveying a powder 8 by gas is formed in a cylindrical body 1 made of insulating material having circular section. A needle electrode having a tip of small curvature radius as plasma electrode 3 of required polarity is disposed along the outlet side of axis of the conduit 2. A high voltage from a power source 5 is applied thereto, and an adhesion-preventing gas 17 is arranged to blow out of a jet 16 provided around the plasma electrode 3 of required polarity. A needle electrode 4 having a tip of large curvature radius as plasma electrode 4 of opposite polarity is disposed to confront the needle electrode 3. Around the plasma electrode 4, a hollow cone 15 is arranged for keep the powder remote from the plasma of opposite polarity. An adhesion-preventing gas 19 is arranged to blow around the electrode 4 of opposite polarity through a jet 18.

In this embodiment, the powder passes through the part of plasma electrode of opposite polarity of cunduit 2 without entering the area 4 wherein mainly ions of opposite polarity exist, and thereafter, is agitated to finely disperse by a dispersing gas 11*a* blown out of a ring-formed jet 11 for dispersing gas. The finely dispersed powder is collected in the axial part of conduit 2 by the same dispersing gas, and enters the area 13 in which mainly ions of required polarity exist. Consequently, charging of powder is very efficiently performed without a substantial neutralization by charges from plasma electrode 4 of opposite polarity. Thus, a sufficiently charged powder 9 can be obtained.

Generally in the case of the powder charging apparatus in accordance with this invention, when the volt-ampere characteristic of the plasma electrode of required polarity is set to be larger than that of the plasma electrode of opposite polarity, a higher efficiency is liable to be obtained. However, when a special means for keeping the powder aloof from the space 14 wherein mainly ions of opposite polarity exist is provided as in the embodiments shown by FIGS. 1, 3, 4, 5, 6 and 8, a difference in the volt-ampere characteristic between two plasma electrodes is not always required.

Figure 9:
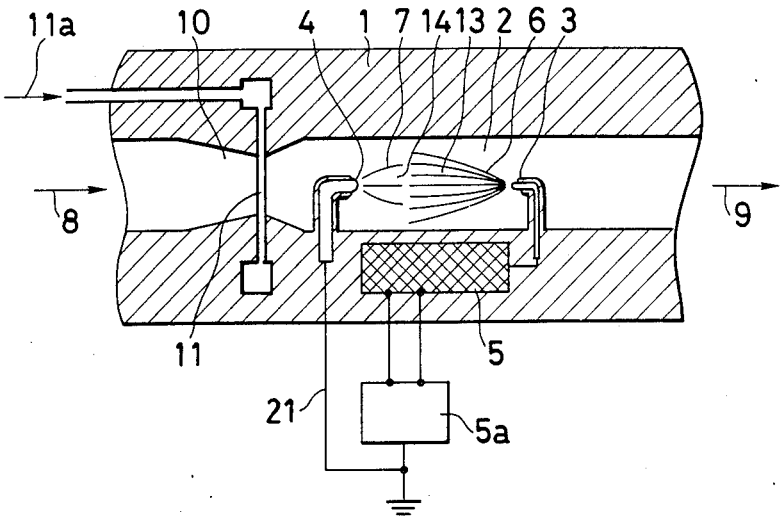

The embodiment of this invention shown in FIG. 9 illustrates an example in which charging of a powder is performed principally due to the effect given by the fact that the difference in volt-ampere characteristic between the plasma electrode 3 of required polarity and the plasma electrode 4 of opposite polarity is made great in operation.

In FIG. 9, a conduit 2 for transferring a powder 8 carried by gas is formed in a cylindrical body 1 made of insulating material having circular section. A plasma electrode 3 of required polarity made of durable material having a tip of very small curvature radius is arranged along the axis of conduit 2. Confronting said electrode, an earthed plasma electrode 4 of opposite polarity having a tip of large curveture radiüs is disposed. A high DC voltage from a DC power source 5 is arranged to apply to the plasma electrode 3 of required polarity. In order to pass a powder in finely dispersed state into the area of plasma electrode of required polarity via the area of plasma electrode of opposite polarity, a restriction 10 is provided upstream from the plasma electrode 4 of opposite polarity, and a dispersing gas 11*a* is made to blowout of a ring-formed jet 11 provided in the part of restriction. Reference numeral 5*a* designates a high frequency power supply for feeding the DC high voltage circuit 5. When the apparatus is constructed as just described, the powder carried by gas which has been sufficiently dispersed is subject to charging.As the powder passes first an area 14 wherein mainly ions of opposite polarity exist, which has been generated downstream from the plasma electrode 4 of opposite polarity, the powder is temporarily charged to be of opposite polarity. Then, the charged powder passes through an area 13 wherein an intense ionic current of required polarity exists, which is derived from the plasma electrode 13 of required polarity having a sufficiently large volt-ampere characteristic. Whereupon, charges on powder which has been given previously are neutralized and charges of required polarity are sufficiently given to the powder. The obtained charged powder is discharged outside as shown by arrow 9. To realize this process, it is required that a large difference in volt-ampere characteristic exists between both electrodes. In some cases, the amount of powder to be treated or the selection of the polarity to be given may restrict the application of this embodiment. However, although the structure in this embodiment is simple, the structure will suffice for the purpose of this invention as the case may be. In addition, when the powder is fed in a sufficiently dispersed state to the sections of electrode by virtue of the characteristic of carrying gas, the feeding amount of powder, the wind velocity of carrying gas etc., the powder-dispersing means 10 and 11 employed in this embodiment can be omitted. It is intended that such a structure is also included in the scope of this invention.

Figure 10:
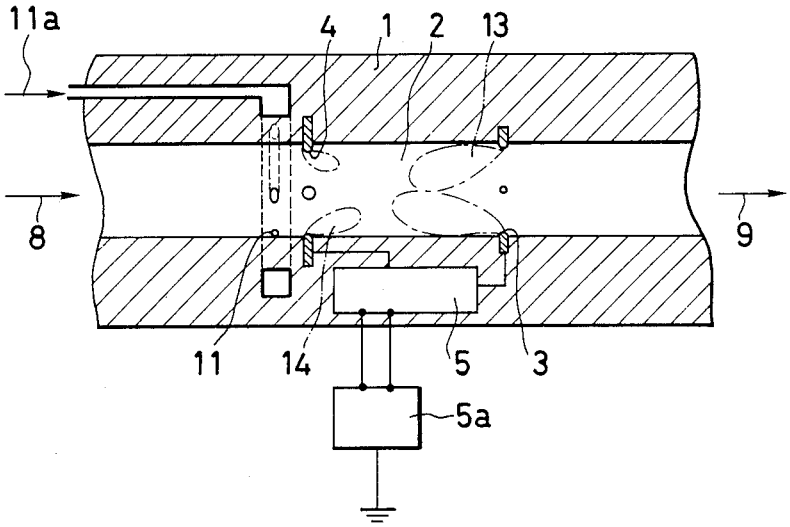

In the embodiment shown by FIG. 10, a conduit 2 for conveying a powder 8 carried by gas is formed within a cylindrical body 1 made of insulating material having circular section. A plasma electrode 3 of required polarity having a tip of very small curveture radius is arranged on the inside surface of conduit 2. Confronting said electrode, a plasma electrode 4 of opposite polarity having a tip of large curvature radius is disposed also on the inside surface of conduit 2. A DC voltage from a DC power source 5 is arranged to apply between them. In this embodiment as well as in other embodiments, the earthing of one of electrodes is not always required, if necessary. The case wherein a voltage derived from midway point of the powder source 5 is applied to one of electrodes as in this embodiment is also included in the scope of this invention.

Further in this embodiment, a jet 11 is provided on the inner surface of conduit 2 for blowing a dispersing gas 11*a* tangentially into the conduit. Whereby, the powder is finely dispersed near the wall, passes first through an area 14, formed near the plasma electrode of opposite polarity, wherein mainly ions of opposite polarity exist, and then passes through an area 13 wherein mainly ions of required polarity exist. However, as the curvature radius of tip of electrode is far different betewen both electrodes and the area 13 wherein mainly ions of required polarity exist is broader and more intense than the area 14 wherein mainly ions of opposite polarity exist, the powder as a whole acquires sufficient charges of required polarity. The obtained charged powder 9 is discharged out of the apparatus. In this embodiment as well as in the embodiment shown by FIG. 9, when the powder which has been finely dispersed enters the conduit 2, the provision of means 11 for dispersing powder and of a dispersing gas may not necesarily be required. Such a variation of this embodiment is also included in the scope of this invention.

Figure 11:
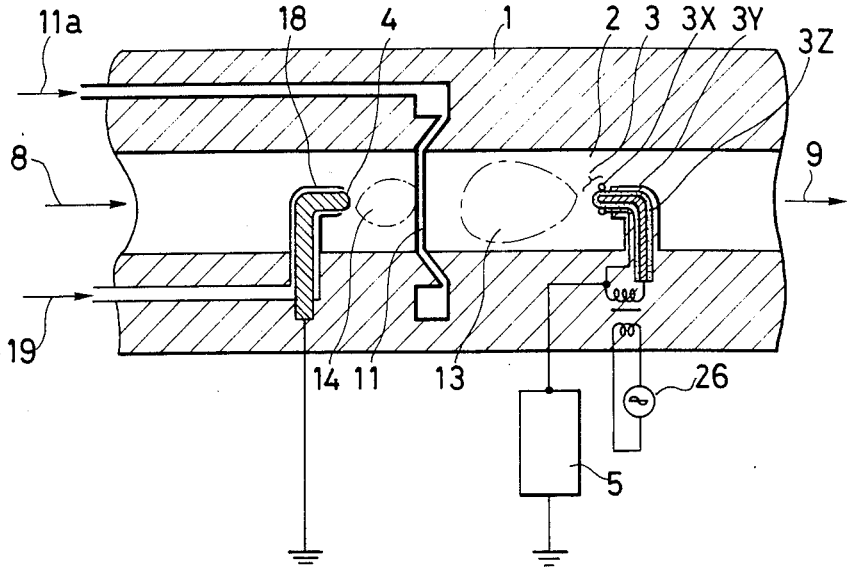

FIG. 11 illustrates a powder charging apparatus as an embodiment of this invention, which is preferably employed when a powder charging of high efficiency and large capacity is intended by increasing the plasma-generating performance of the plasma electrode of required polarity.

In the embodiment shown by FIG. 11 also, a conduit 2 for transferring a powder 8 carried by gas is formed within a cylindrical body 1, made of insulating material, having circular section. A plasma-generating electrode of AC driving type as plasma electrode 3 of required polarity is disposed along the axis of conduit 2. This plasma electrode 3 of required polarity is composed of a thin tubular insulation 3Y made of ceramics etc. having the forward end closed into which a core electrode 3Z is inserted, the outside of said tubular insulation being wrapped with a coiled surface electrode 3X. A high AC voltage is applied between the core electrode 3Z and the surface electrode 3X by an AC power source 26 by way of a transformer. In addition, a DC voltage from a DC power source 5 is applied thereto.

Confronting the electrode 3, a corona discharge electrode 4 having a tip of large curveture radius is usually disposed as plasma electrode of opposite polarity. An adhesion-preventing gas 19 can be blown out of jet 18 which is arranged around the corona discharge electrode 4 to prevent the powder from adhesion to the tip of electrode 4, if necessary. The corona discharge electrode 4 is earthed. Further, a dispersing gas 11*a* is arranged to blow out of a ring-formed jet 11 which opens midway between both electrodes. Whereby, the powder transferred there is finely dispersed.

In the case of the plasma electrode of required polarity employed in this embodiment, a very intense AC plasma is generated around the surface electrode 3X because of a high AC voltage applied between the surface electrode 3X and the core electrode 3Z. A sufficiently large amount of ions of required polarity can be drawn from said plasma and an intense area 13 wherein mainly ions of required polarity exist is formed. Thus, this embodiment is preferred to realize a powder charging apparatus of high intensity and large capacity in accordance with this invention.

On the other hand, particles of powder cannot approach near the plasma electrode 3 of required polarity because of a very intense uneven alternating electric field generated around said electrode. Accordingly, no special means for preventing adhesion is required in many cases. However, to prevent the adhering of powder at the time of stoppage of starting, an adhesion-preventing gas may be introduced around the electrode. Reference numerals which has not been explained in the description of FIG. 11 mean the same as in other figures. The system for applying an AC voltage between both plasma generating electrodes is not always limited to the method where the voltage is applied by way of a transformer as in this embodiment. A ripple voltage overlapped with a DC voltage may be utilized by selecting suitably the number of stage of a high voltage generating circuit or its circuit constants.

Figure 12:
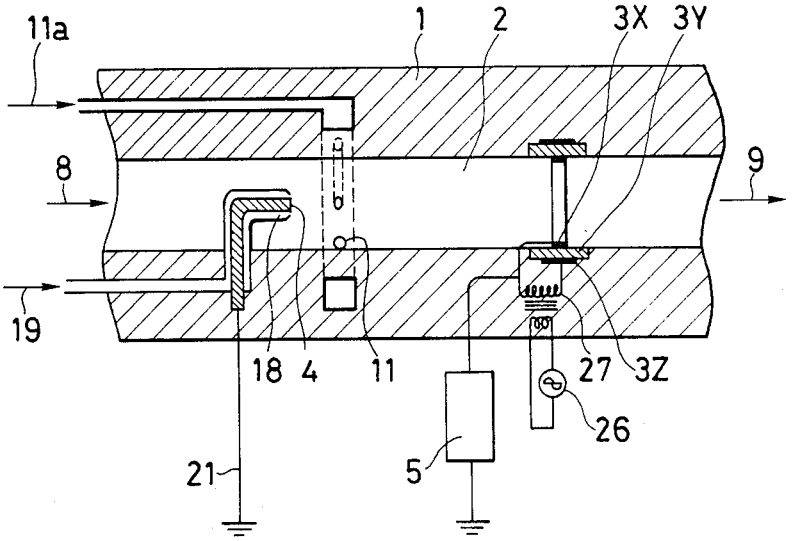

FIG. 12 illustrates one embodiment according to this invention wherein a conduit 2 for conveying a power 8 carries by gas is formed in a cylindrical body 1 made of insulating material having circular section. This embodiment as a powder charging apparatus of this invention is characterized by being constructed by arranging a ring-formed AC plasma generating electrode for generating intense ions of required polarity along the interior surface of conduit 2 and arranging a plasma electrode 4 of opposite polarity which has a tip of large curvature radius and confronts said ring-formed electrode. In FIG. 12, a ring-formed insulation 3Y usually made of ceramic is provided along the inside surface of conduit 2. A surface electrode 3X composed of thin wire is arranged along the inner surface of insulation 3X. A ring electrode 3Z of broad ribbon form is arranged along the back surface of insulation 3X. An AC power source 26 is so connected that an AC high voltage is applied between electrodes 3Y and 3Z by way of a transformer 26. To raise the polential as a whole of both electrodes impressed with AC voltage, a DC power source 5 is connected. The plasma electrode 4 of opposite polarity is earthed via a conductor 21. An adhesion-preventing gas 19 is arranged to blow out of a jet 18 provided around the plasma electrode 4 of opposite polarity. On the other hand, a dispersing gas 11*a* is arranged to blow out midway between both electrodes by means of a jet 11 for injecting dispersing gas. Whereby, the powder is finely dispersed and passes near the inside wall of conduit. In this embodiment, a very intense AC plasma is generated around the electrode 3X by an action of a high AC voltage applied between electrodes 3X and 3Z. A very large amount of ion of required polarity is continuously drawn from the AC plasma to go toward the plasma electrode of opposite polarity, by virtue of a DC electric field directed toward the plasma electrode of opposite polarity, which is generated by the DC power source 5. Thus, the finely dispersed powder which approaches the conduit wall and passes near the electrode can be electrically charged to be discharged outside as a very intensely charged powder 9. This system constitutes an embodiment of this invention, which can be advantageously employed when a large amount of powder having a high charge density is desired to obtain.

In the embodiments of FIGS. 1 to 12 detailed above, a corona discharge electrode having a tip of small curvature radius or an AC plasma generating electrode is primarily employed as plasma electrode of required polarity, and a corona discharge needle electrode having a tip of relatively large curvature radius is employed as plasma electrode of opposite polarity. Further, a restriction in conduit, a dispersing gas, or a revolving gas flow is employed as means for dispersing the powder. A baffle also may be used. As for means for keeping the powder aloof from an area wherein principally ions of opposite polarity are present, a space in which a gas for carrying the powder does not flow, a cone, a change in diameter of conduit in the longitudinal direction, or a baffle device as that shown in FIG. 6 is employed. In so far as the object of this invention can be achieved, any combination of these means is possible. After selecting each of means from their respective groups depending on the object, the combination thereof may be utilized.

Means for preventing the adhesion and the accumulation of the powder on both electrodes can be selected from the group consisting of a system of blowing out of gas for enveloping the electrode, a system of utilizing of a plasma generating electrode of AC driving type, or a combination thereof to apply, depending on the object.

Figure 13:
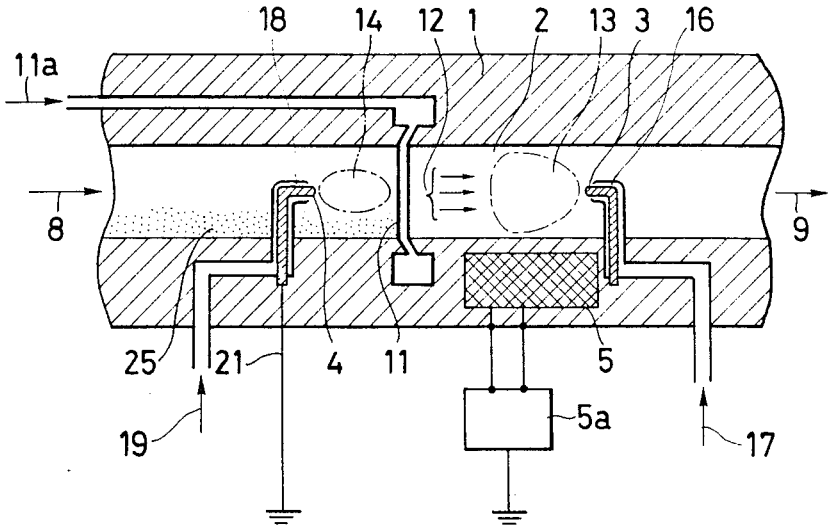

FIG. 13 illustrates one embodiment according to the present invention wherein a conduit 2 for transferring a powder 8 carried by gas is formed in a cylindrical body 1 made of insulating material having circular section. In the conduit 2, a needle electrode 3 surrounded by jet 16 for blowing out an adhesion-preventing gas 17 is arranged along the axis of conduit as plasma electrode of required polarity. With confronting said needle electrode 3, a plasma electrode 4 of opposite polarity which is surrounded by jet 18 for blowing out an adhesion-preventing gas 19 is arranged along the axis. A high DC voltage is arranged to apply between these electrodes by means of a multistage booster circuit 5 and a high frequency power supply 5*a*. In addition, a ring-formed jet 11 is disposed somewhat upstream from the midpoint between both electrodes and a dispersing gas 11*a* is arranged to blow out of said jet 11 into said conduit 2.

In an usual powder charging apparatus to be used in an electrostatic powder coating apparatus, conveying of powder in the conduit is rarely required to be performed at high speed in many cases. Accordingly, in usual cases, the powder flows unevenly as shown by reference numeral 25. Although a part of powder passes an area 14, formed around the tip of the plasma electrode 4 of opposite polarity, wherein primarity ions of opposite polarity exist, most of the powder is not subjected to charging in substance, in many cases. The powder which has passed the zone of plasma electrode 4 is finely dispersed by an intense dispersing gas 11*a* blown out of jet 11 arranged immediately downstream from the area 14. The obtained finely dispersed powder 12 passes through an area 13 wherein mainly ions of required polarity exist. By this process, the powder can be charged substantially only by ions of required polarity with preventing the neutralization of charges on powder with ions of opposite polarity. Thus-obtained charged powder 9 is stable for a long time. Whereas, in the other embodiments (refer to FIGS. 1, 4, 6 and 8), special means merely for keeping the powder aloof from the area wherein ions of opposite polarity exist is provided, such special means is not provided in the case of the embodiment shown in FIG. 13. However, it does not mean that the prevention of powder passing through area 14 is not contemplated in the embodiment of FIG. 13.

In the following embodiments, the use of the powder charging apparatus according to this invention in an electroststic powder coating apparatus is explained in detail. In these embodiments also, the essential constituents of this invention, such as plasma electrodes, means for dispersing the powder and means for keeping the powder aloof from the area wherein mainly ions of opposite polarity exist, can be suitably selected and combined to employ, depending on the object of application.

Figure 14:
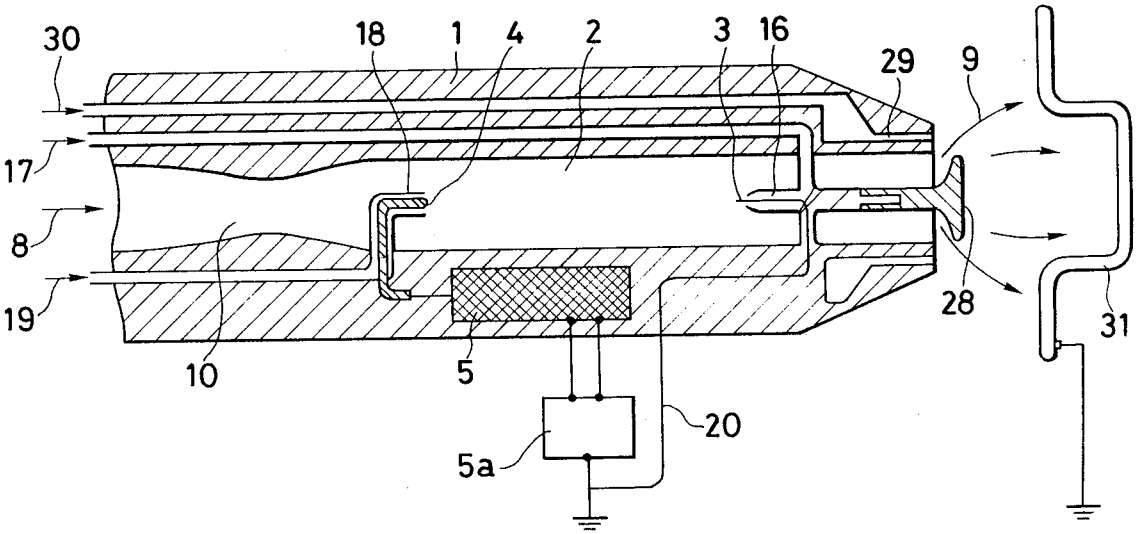
FIGS. 14 to 17 show longitudinal sections of electrostatic powder coating apparatuses as embodiments of this invention, respectively.

FIG. 14 show an embodiment wherein a powder charging apparatus according to this invention is employed to construct an electrostatic powder coating apparatus with excellent throwing power. A conduit 2 for conveying a powder 8 carried by gas is formed in a cylindrical body 1 made of insulating material having a circular section. A needle electrode having a tip of small curvature radius as plasma electrode 3 of required polarity is disposed near the forward end of conduit 2. Confronting the needle electrode, a needle-formed corona discharge electrode having a tip of large curvature radius is disposed as plasma electrode 4 of opposite polarity. A high DC voltage is applied between both electrodes by means of a DC power source 5 and said plasma electrode 3 of required polarity is earthed via a conductor 20. Reference numeral 5*a* designates a high frequency power supply for feeding the DC power source 5. To disperse finely the powder, a restriction 10, for example, can be provided upstream from the plasma electrode 4 of opposite polarity, if necessary. Thereby, the powder in finely dispersed state passes first through a space wherein mainly ions of opposite polarity exist. Thereafter, the powder passes through a space wherein mainly ions of required polarity are present, and is discharged as intensely charged powder 9 from the outlet at the forward end of conduit. A distributing plate 28 is provided for modifying the pattern of distribution of discharged powder, whereby the pattern of distribution can have a suitable spread. When limiting of said spread is desired, a pattern-modifying gas shown by arrow 30 is made to blow out of a jet 29 for blowing out pattern-modifying gas. Thus, the pattern of distribution is modified. Reference numeral 31 designates a substrate. As the end of thus-constructed electrostatic powder coating apparatus of this invention is maintained to be earthed by a wire 20, no electric field is generated between said end and the substrate. When the powder 9 blown out of the forward end of electrostatic powder coating apparatus is sprayed onto the substrate, no so-called Faraday cage effect arises, in contrast to the common electrostatic powder coating apparatus wherein due to the effect of electric field being directed from the tip of gun to the substrate, the deposition of coating material is concentrated to places of intense electric field and is scarcely performed at depressed areas. In accordance with this invention, as the powder sprayed onto the substrate is deposited thereon by a space-charge field effect derived of charges of the powder themselves only when the powder approaches the substrate, an electrostatic powder coating can be conducted with excellent throwing power. Further, when the powder is charged in excess and the forward end of gun has no electric charge, the powder is distributed too broadly, due to the mutual repulsion of charged particles, to enter narrow spaces. When this is the case, the wire 20 is connected to a terminal of the power source 5 having a suitably high DC potential to generate weak electric field betewen the gun and the substrate. Thus-arranged electrostatic powder coating apparatus in which the coating is conducted with sufficiently high and efficient throwing power is also included in the scope of this invention.

In addition, to prevent adhering of powder to the tips of electrodes in the transient state when the starting is stopped, adhesion-preventing gases 17 and 19 are used, as in the case of other embodied electrostatic power coating apparatus mentioned above.

Figure 15:
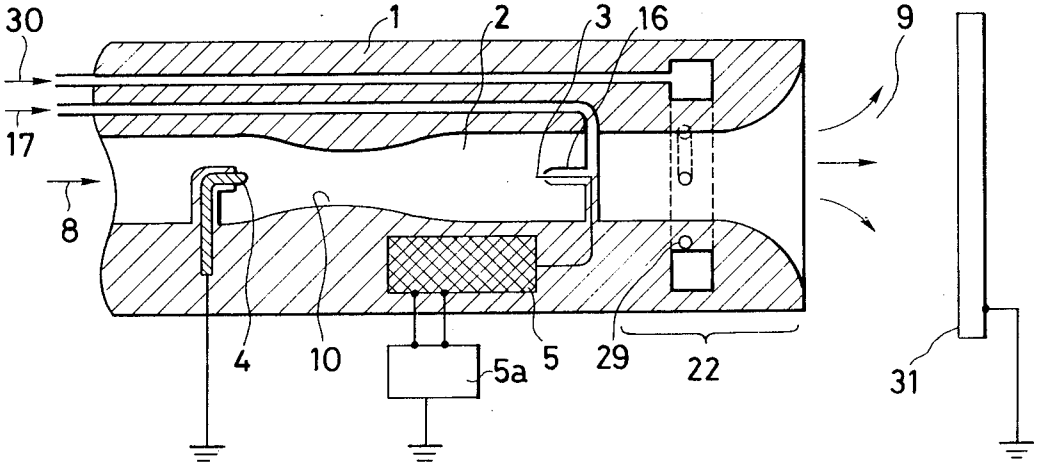

FIG. 15 illustrates an electrostatic powder coating apparatus implemented with a powder charging apparatus of this invention, which is preferred when an electrostatic powder coating is intended to obtain a thick coating. A conduit 2 for conveying a powder 8 carried by gas is formed in a cylindrical body 1 made of insulating material having circular section. A short conduit 22 including device 29 for modifying the pattern of distribution of powder is attached to the forward end of conduit 2 so that the axis of short conduit may be in alignment with the axis of conduit 2. A corona discharge electrode 3 having a tip of very small curvature radius as plasma electrode of required polarity is disposed upstream from said short conduit 22. Confronting the electrode 2, a plasma electrode 4 of opposite polarity having a tip of relatively large curvature radius is disposed and is earthed. A high DC voltage from a DC power source 5 is applied to the plasma electrode 3 of required polarity. Reference numeral 5*a* designates a high frequency power supply for feeding the high DC power source 5. Further, means for dispersing the powder, such as restriction 10, is arranged between electrode 3 and electrode 4, as detailed hereinbefore. To modify the pattern of distribution of charged powder 9, the flow rate of a patternmodifying gas shown by arrow 30 is regulated. Reference numerals 31 and 16 designate a substrate and a jet for blowing out an adhesion-preventing gas 17, respectively. The adhesion-preventing gas is for preventing adhering of powder to the tip of plasma electrode of required polarity. In thus-constructed electrostatic powder coating apparatus according to this invention, the finely dispersed powder is sufficiently charged between the plasma electrode of required polarity and the plasma electrode of opposite polarity as detailed herein before, and is sprayed onto a substrate through the short conduit 22. As the plasma electrode of required polarity to which a high voltage is applied is near the discharging outlet, an intense DC field being directed to the substrate is generated, the charged powder proceeds to substrate by the action of this electric field to deposit. In this case, as the current which flows from the plasma electrode of required polarity to the substrate is suppressed sufficiently in substance by the existence of short conduit 22, an ionic current being directed from the forward end of the electrostatic powder coating apparatus to substrate do not exist at the surface of substrate. Accordingly, a backward ionization can hardly arise and only the electric field exists. Therefore, the depositing efficiency can be maintained to be be high. Thus, the electrostatic powder coating can be practiced to obtain a thick coating, without backward ionization.

Figure 16:
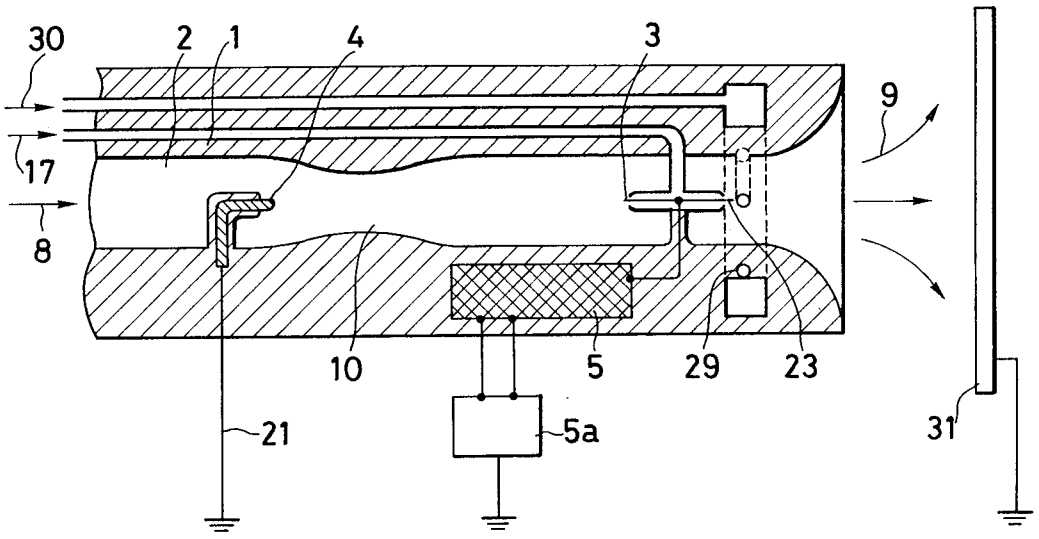

FIG. 16 shows an electrostatic powder coating apparatus of high performance, as one embodiment of this invention, which is constructed by employing a powder charging apparatus according to this invention, wherein the electrostatic powder coating can be performed with very high depositing efficiency and excellent throwing powder. Referring to FIG. 16, a conduit 2 for conveying a powder 8 carried by gas is formed within a cylindrical body 1 made of insulating material having circular section. A plasma electrode 3 of required polarity is arranged along the axis of conduit 2 near the outlet thereof and a high voltage from a power source 5 is applied to the electrode. An substrate-confronting corona electrode 23 which is connected to the electrode 3 is arranged to be directed toward the outlet. In addition, a corona discharge electrode 4 having a tip of relatively large curvature radius as plasma electrode 4 of opposite polarity is disposed as can be seen in the drawing and is earthed by a conductor 21. Reference numeral 5*a* designates a high frequency power supply for feeding the DC power source 5. An adhesion-preventing gas shown by arrow 17 is used for preventing the tip of plasma electrode of required polarity and that of substrate-confronting corona electrode 23 from adhering of powder. A pattern-modifying gas shown by arrow 30 is blown out of jet of the device 29 for modifying the pattern of distribution of powder, which opens near the end of conduit 2, to form a revolving flow. The pattern of distribution of the charged powder 9 which is blown out of the electrostatic powder coating apparatus can be regulated by modifying the amount of the gas blown out of jet of the device 29. In this embodiment, the powder is intensely charged between the plasma electrode 3 of required polarity and the plasma electrode 4 of opposite polarity to have the same polarity with that of the plasma electrode 3 due to the powder charging mechanism detailed hereinbefore. In addition to the discharged powder having been intensely charged, the powder is again charged by corona discharge as well as the intense field which is generated to be directed from the tip of the substrate-confronting corona electrode 23 to the substrate. By virtue of large amount of charges on powder and the intense electric field being directed from the forward end of the electrostatic powder coating apparatus to the substrate, the electrostatic powder coating can be performed with very high efficiency and high throwing power. Thus, an electrostatic powder coating apparatus having a high performance is obtained in accordance with this invention.

In the electrostatic powder coating system in this embodiment, the essential constituents detailed above of the powder charging apparatus of this invention can be suitably selected as practical means and combined to employ, depending on the object of application. Besides the abovementioned methods for forming of pattern of distribution and modifying thereof, all commonly known means and methods can be applied. These situations are encountered in embodiments shown in FIGS. 13 and 14.

Figure 17:
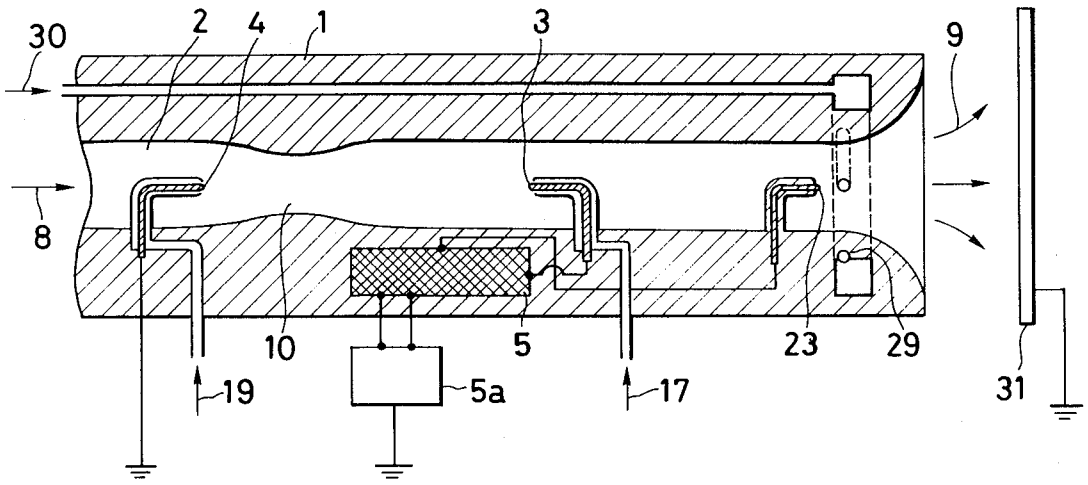

FIG. 17 illustrates an electrostatic powder coating apparatus, as one embodiment of this invention, which is constructed by using a powder charging apparatus according to this invention, wherein the electrostatic powder coating can be conducted with the depositing efficiency in harmony with the throwing power. In FIG. 17, a conduit 2 for conveying a powder 8 carried by gas is formed in a cylindrical body 1 made of insulating material having circular section. A substrate-confronting corona electrode 23 which is directed to and confronts a substrate 31 is disposed along the axis of conduit near the outlet thereof. A plasma electrode 3 of required polarity is arranged upstream and somewhat distant from the electrode 23. The highest voltage of a power source 5 is a applied to the electrode 3 and an intermediate voltage is applied to the substrate-confronting corona electrode 23. A plasma electrode 4 of opposite polarity which is disposed the most upstream is earthed.

In this embodiment, charging of the powder is conducted between the electrode 4 and the electrode 3 as in other embodiments. Furthermore, the intermediate voltage applied to the electrode 23 is selected to generate an electric field in such a degree as to promote suitably the running of powder 9 toward the substrate without deteriorating the throwing power or charge powder flow 9. As a result, it is provided an electrostatic powder coating apparatus with an intermediate throwing power in harmony with depositing efficiency.

In the descriptions above, needle electrodes or plasma generating electrodes of AC driving type are emplyed as plasma generating electrode of required or opposite polarity, for illustrating. However, other electrode capable of generating plasma, such as thin wire of knife edge form, can be used. Further, an electrode of AC driving type is employable as the elctrode of opposite polarity of this invention.

The apparatus and the system of this invention are as mentioned above. As each of electrode couple employed for charging the powder is a needle electrode, a knife edge electrode, a wire electrode, or a plasma generating electrode of AC driving type, which always repel intensely the powder in operation, no powder adheres to and accumulates on each electrode in operation. A stable operation of the apparatus can be secured amidst powder for a long time. For the purpose of charging a powdered coating material, a high and stable performance of the apparatus can be maintained irrespective of material properties of the powder. By combining the powder charging apparatus of this invention in which an intensely charged powder is produced with an external electric field, an external ionic current and means for modifying the pattern of powder distribution, novel electrostatic powder coating apparatuses which are remarkably excellent in throwing power, depositing efficiency and performance for obtaining thick coating can be completed. These apparatuses are stably operated for a long period of time. Even when the apparatus is without applied external electric field and external ionic current, the aforementioned electrostatic powder coating apparatus is also very useful. It is considered almost impossible in the prior art that such an electrostatic powder coating apparatus is stably operated for a long time with high efficiency, irrespective of material properties of powdered coating material.

Figure 18:
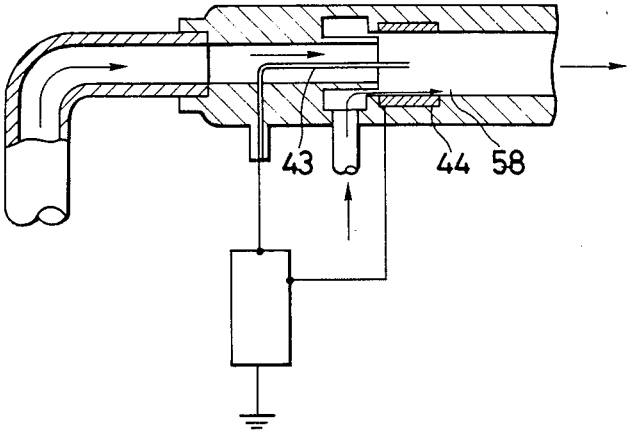
FIG. 18 PRIOR ART
FIGS. 18 and 19 show longitudinal sections of powder charging apparatuses of the prior art.
Figure 19:
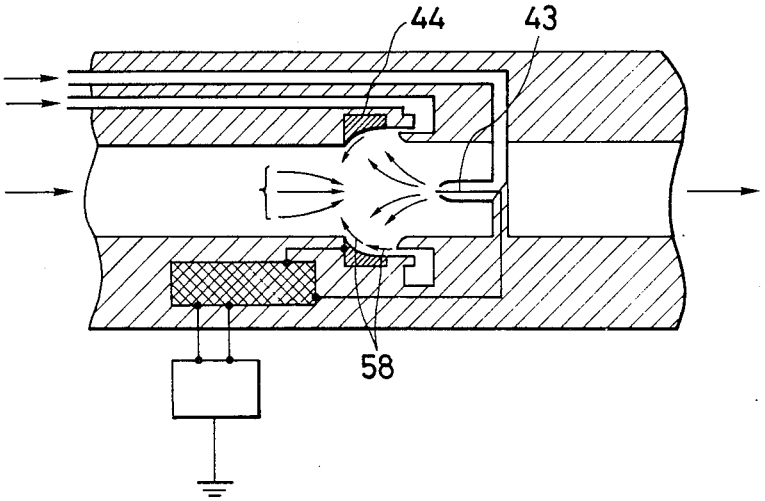
FIG. 19 PRIOR ART

In constrast to the powder charging apparatus according to this invention, one electrode of electrode couple used for charging the powder is a corona discharge electrode 43 as shown in FIGS. 18 and 19, and the other electrode is a substantially smooth cylindrical electrode 44 in the powder charging apparatus of the prior art shown by FIGS. 18 or 19. In the operating state, a high voltage is applied between both electrodes and only a unipolar ionic current of required polarity flows from the corona discharge electrode 43 to the cylindrical electrode 44. Accordingly, particles of powder essentially tend to adhere to and accumulated on the surface of cylindrical electrode 44. Once particles of powder adhere even if in minute amount, they cause the backward ionization from which an ionic current of opposite polarity flows backward to the corona discharge electrode 43 to neutralize ions or charges of required polarity. Therefore, the charging capability of the electrode rapidly lowers with increasing amount of adhering and accumulating particles of powder. Thus, a long-term operation is difficult. These phenomena are remarkable especially in the case of charging a powdered coating material having a low melting point and a high adhesion. An actual stable operation for more than some hours is impossible to realize, even if countermeasures, such as selection of material, shape and surface fabrication of cylindrical electrode 44 and regulation of amount and blowing out speed of clean air 58, are taken.

In the drawings and specification there have been set forth preferred embodiments of the invention, and although specific terms are employed, they are used in a generic and descriptive sense only and not for purposes of limitation.

What is claimed is:

1. A powder charging apparatus comprising: an insulating conduit for conveying a powder by gas, a couple of plasma electrodes arranged in said conduit for generating ions of required polarity and ions of opposite polarity, an area within said conduit wherein mainly ions of required polarity exist, an area within said conduit wherein mainly ions of opposite polarity exist, and means for feeding finely dispersed powder through said area wherein mainly ions of required polarity exist.

2. The apparatus as defined in claim 1, further including means for keeping powder aloof from said area wherein mainly ions of opposite polarity exist.

3. The apparatus in claim 2 in which said means for keeping powder aloof comprises said area wherein mainly ions of opposite polarity exist being located remote from the area through which powder is conveyed.

4. The apparatus in claim 2 in which said means for keeping powder aloof comprises a cone positioned in said conduit in said area wherein mainly ions of opposite polarity exist and defining a throat opening downstream.

5. The apparatus in claim 2 in which said means for keeping powder aloof comprises a restriction in the peripheral wall of said conduit immediately upstream of said area wherein mainly ions of opposite polarity exist.

6. The apparatus as defined in claim 1, in which the volt-ampere characteristic of the plasma electrode of required polarity is made larger than that of the plasma electrode of opposite polarty.

7. The apparatus as defined in claim 1, in which said area wherein mainly ions of required polarity exist is situated near the tip of the plasma electrode located downstream with reference to the direction of conveying powder.

8. The apparatus as defined in claim 1 further including means associated with one of said plasma electrodes for preventing adhesion of powder to the electrode.

9. The apparatus as defined in claim 1 in which the plasma electrode of required polarity is connected to earth.

10. An electrostatic powder coating apparatus implemented with a powder charging apparatus comprising: an insulating conduit for conveying a powder by gas, a couple of plasma electrodes consisting of a plasma electrode of required polarity and a plasma electrode of opposite polarity for generating ions of required polarity and ions of opposite polarity, a power source means for applying a DC voltage between said couple of plasma electrodes, an area within said conduit wherein mainly ions of opposite polarity exist, both of said ions being derived of said couple of plasma electrodes, and means for feeding finely dispersed powder through said area wherein mainly ions of required polarity exist, said plasma electrode of required polarity being arranged on the outlet side of said conduit.

11. The apparatus as defined in claim 10, in which said plasma electrode of required polarity is connected to earth.

12. The apparatus as defined in claim 10 further including a short conduit joined to the outlet side of said insulating conduit.

13. The apparatus as defined in claim 10, in which said plasma electrode of opposite polarity is connected to earth, said plasma electrode of required polarity is placed near the forward end of the conduit, and further including a corona electrode downstream of said plasma electrode of required polarity and facing outwardly toward an object to be coated.

14. The apparatus as defined in claim 2, which said area wherein mainly ions of required polarity exist is situated near the tip of the plasma electrode located downstream with reference to the direction of the conveying powder.

15. The apparatus as defined in claim 6, which said area wherein mainly ions of required polarity exist is situated near the tip of the plasma electrode located downstream with reference to the direction of the conveying powder.

16. The apparatus as defined in claim 2, further including means associated with one of said plasma electrodes for preventing adhesion of powder to the electrode.

17. The apparatus as defined in claim 6, further including means associated with one of said plasma electrodes for preventing adhesion of powder to the electrode.

18. The apparatus as defined in claim 7, further including means associated with one of said plasma electrodes for preventing adhesion of powder to the electrode.

19. The apparatus as defined in claim 2, in which the plasma electrode of required polarity is connected to earth.

20. The apparatus as defined in claim 6, in which the plasma electrode of required polarity is connected to earth.

21. The apparatus as defined in claim 7, in which the plasma electrode of required polarity is connected to earth.

22. The apparatus as defined in claim 8, in which the plasma electrode of required polarity is connected to earth.

23. The apparatus as defined in claim 11, further including a short conduit joined to the outlet side of said insulating conduit.

24. The apparatus as defined in claim 11, in which said plasma electrode of opposite polarity is connected to earth, said plasma electrode of required polarity is placed near the forward end of the conduit, and further including a corona electrode downstream said plasma electrode of required polarity and facing outwardly toward an object to be coated.

25. The apparatus as defined in claim 12, in which said plasma electrode of opposite polarity is connected to earth, said plasma electrode of required polarity is placed near the forward end of the conduit, and further including a corona electrode downstream said plasma electrode of required polarity and facing outwardly toward an object to be coated.

26. The apparatus in claim 2 in which said area wherein mainly ions of required polarity exist is downstream of said area wherein mainly ions of opposite polarity exist and in which said means for keeping powder aloof comprises injecting powder into said conduit between said areas.

27. The apparatus in claim 2 in which said means for keeping powder aloof comprises said area wherein mainly ions of required polarity exist being downstream of said area wherein mainly ions of opposite polarity exist, conveying means for conveying powder through said area wherein mainly ions of opposite polarity exist at a high speed, and dispersion means between said areas whereby the powder flows unevenly in the vicinity of said area wherein mainly ions of opposite polarity exist and is evenly disbursed by said dispersion means prior to passing through said area wherein mainly ions of required polarity exist.

28. A powder charging method including generating plasma between a pair of plasma electrodes positioned within an insulating conduit, one of said electrodes generating ions of required polarity and other one of said electrodes generating ions of opposite polarity, and feeding dispersed powder through the area within said insulating conduit wherein mainly ions of required polarity exist.

29. The method in claim 28 further including keeping the powder aloof from the area within said insulating conduit wherein mainly ions of opposite polarity exist.

30. The apparatus in claim 7 in which said power source further includes means for applying an AC voltage combined with said DC voltage between said couple of plasma electrodes.

* * * * *

UNITED STATES PATENT AND TRADEMARK OFFICE

CERTIFICATE OF CORRECTION

PATENT NO. : 4,772,982

DATED : September 20, 1988

INVENTOR(S) : Hideo Nagasaka

It is certified that error appears in the above-identified patent and that said Letters Patent is hereby corrected as shown below:

Column 1, line 53:
After "traverse" insert -- a --.
Column 2, line 25:
"flowiing" should be -- flowing --.
Column 4, line 55:
"electrode 4" should be -- electrode 5 --.
Column 5, line 11:
"aroung" should be -- around --.
Column 5, line 16:
"current" should be -- currents --.
Column 5, line 36:
"Figs. 3" should be -- Fig. 3 --.
Column 5, line 46:
"electrode 4" should be -- electrodes 4 --.
Column 6, line 65:
"powde" should be -- powder --.
Column 7, line 46:
"spurce" should be -- source --.
Column 8, line 16:
"cunduit 2" should be -- conduit 2 --.
Column 8, line 53:
"curveture" should be -- curvature --.
Column 9, line 32:
"curveture" should be -- curvature --.
Column 9, line 40:
Before "midway" insert -- a --.
Column 9, line 53:
"betewen" should be -- between --.
Column 10, line 19:
"curveture" should be -- curvature --.
Column 11, line 8:
"polential" should be -- potential --.

UNITED STATES PATENT AND TRADEMARK OFFICE

CERTIFICATE OF CORRECTION

PATENT NO. : 4,772,982

DATED : September 20, 1988

INVENTOR(S) : Hideo Nagasaka

It is certified that error appears in the above-identified patent and that said Letters Patent is hereby corrected as shown below:

Column 12, line 38:
"electroststic" should be -- electrostatic --.
Column 13, line 34:
After "generate" insert -- a --.
Column 13, line 35:
"betewen" should be -- between --.
Column 13, line 43:
"power" should be -- powder --.
Column 14, line 1:
"patternmodifying" should be -- pattern-modifying --.
Column 14, line 35:
"powder" should be -- power --.
Column 14, line 41:
"An" should be -- A --.
Column 15, line 34:
"a" should be -- an --.
Column 15, line 45:
"or" should be -- of --.
Column 15, line 51:
"emplyed" should be -- employed --.

Signed and Sealed this

Sixteenth Day of October, 1990

*Attest:*

*Attesting Officer*

HARRY F. MANBECK, JR.

*Commissioner of Patents and Trademarks*